US005984074A

United States Patent [19]

Allan et al.

[11] Patent Number: 5,984,074

[45] Date of Patent: Nov. 16, 1999

[54] METHOD AND APPARATUS FOR VALIDATING MONEY

[75] Inventors: Richard Douglas Allan, Reading; David Michael Furneaux, Maidenhead, both of United Kingdom

[73] Assignee: Mars, Incorporated, McLean, Va.

[21] Appl. No.: 08/239,363

[22] Filed: May 6, 1994

Related U.S. Application Data

[62] Division of application No. 07/848,989, Apr. 29, 1992, abandoned, which is a continuation of application No. PCT/GB90/01588, Oct. 15, 1990.

[30] Foreign Application Priority Data

Oct. 18, 1989 [GB] United Kingdom ..... 8923456

[51] Int. Cl.[6] ..... G07D 5/08

[52] U.S. Cl. ..... 194/317; 194/334

[58] Field of Search ..... 194/302, 303, 194/317, 318, 319, 328, 334, 335

[56] References Cited

U.S. PATENT DOCUMENTS

| | | |
|---|---|---|
| 4,349,095 | 9/1982 | Lewis . |
| 4,705,154 | 11/1987 | Masho et al. . |
| 4,805,754 | 2/1989 | Howells . |
| 4,895,238 | 1/1990 | Speas . |
| 5,002,174 | 3/1991 | Yoshihara . |
| 5,213,190 | 5/1993 | Furneaux et al. . |

FOREIGN PATENT DOCUMENTS

| | | |
|---|---|---|
| 0086648 | 8/1983 | European Pat. Off. . |
| 0101276 | 2/1984 | European Pat. Off. . |
| 0155126 | 9/1985 | European Pat. Off. . |
| 0367921 | 5/1990 | European Pat. Off. . |
| 0384375 | 8/1990 | European Pat. Off. . |
| 2113453 | 6/1972 | France . |
| 2359468 | 2/1978 | France . |
| 2646025 | 4/1978 | Germany . |
| 2924605 | 6/1984 | Germany . |
| 1285305 | 8/1972 | United Kingdom . |
| 1405937 | 9/1975 | United Kingdom . |
| 2071895 | 9/1981 | United Kingdom . |
| 2094008 | 9/1982 | United Kingdom . |
| 2211337 | 6/1989 | United Kingdom . |

*Primary Examiner*—F. J. Bartuska
*Attorney, Agent, or Firm*—Fish & Richardson P.C.

[57] ABSTRACT

An apparatus and method of validating coins involves taking two independent measurements of the tested item, and determining whether both measurements lie within respective ranges for a particular coin type, the range for at least one of the measurements being dependent upon at least one other measurement.

35 Claims, 5 Drawing Sheets

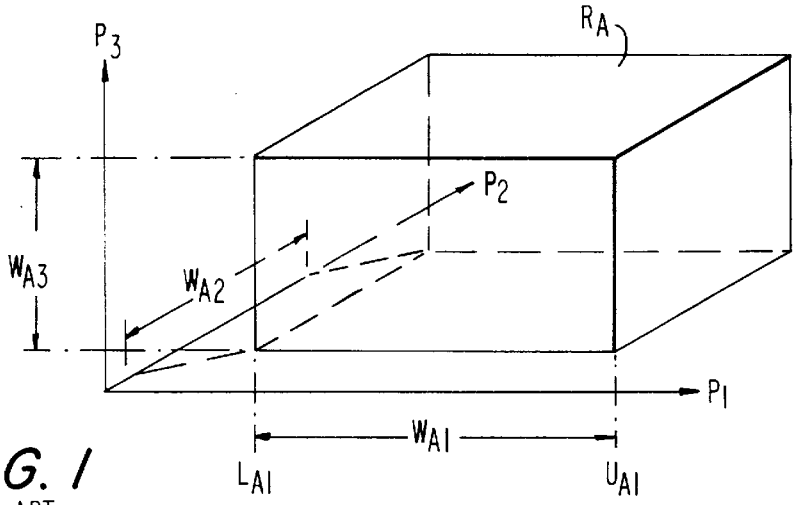
FIG. 1
PRIOR ART
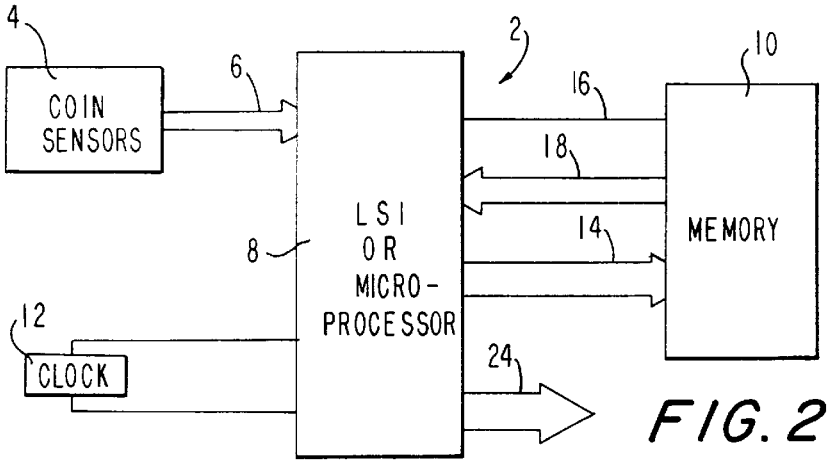
FIG. 2
FIG. 3
| | A | B | C | D | E | F |
|---|---|---|---|---|---|---|
| $P_1$ | $U_{A1}$ | $U_{B1}$ | $U_{C1}$ | $U_{D1}$ | $U_{E1}$ | $U_{F1}$ |
| | $L_{A1}$ | $L_{B1}$ | $L_{C1}$ | $L_{D1}$ | $L_{E1}$ | $L_{F1}$ |
| $P_2$ | $U_{A2}$ | $U_{B2}$ | $U_{C2}$ | $U_{D2}$ | $U_{E2}$ | $U_{F2}$ |
| | $L_{A2}$ | $L_{B2}$ | $L_{C2}$ | $L_{D2}$ | $L_{E2}$ | $L_{F2}$ |
| $P_3$ | $U_{A3}$ | $U_{B3}$ | $U_{C3}$ | $U_{D3}$ | $U_{E3}$ | $U_{F3}$ |
| | $L_{A3}$ | $L_{B3}$ | $L_{C3}$ | $L_{D3}$ | $L_{E3}$ | $L_{F3}$ |

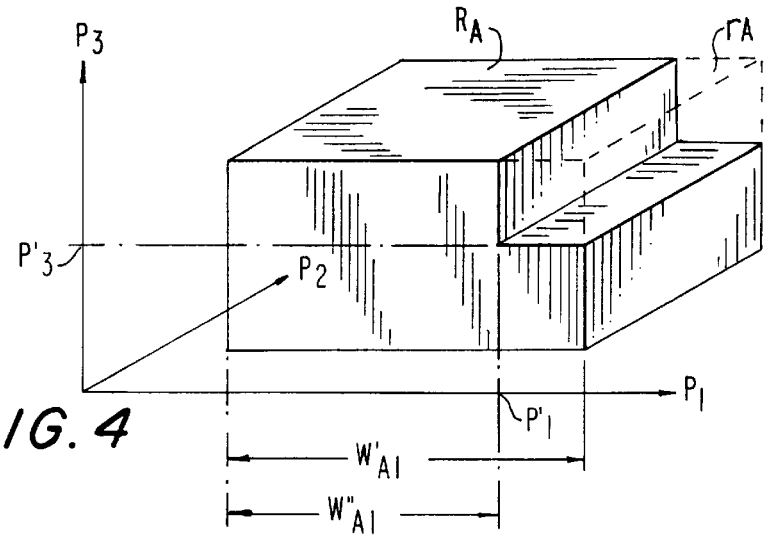
FIG. 4
FIG. 5
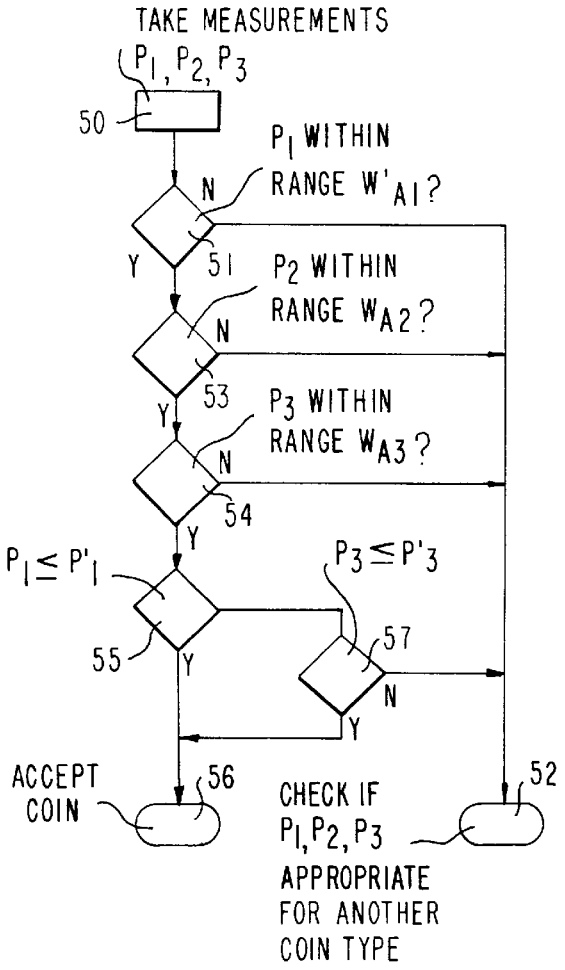
FIG. 6
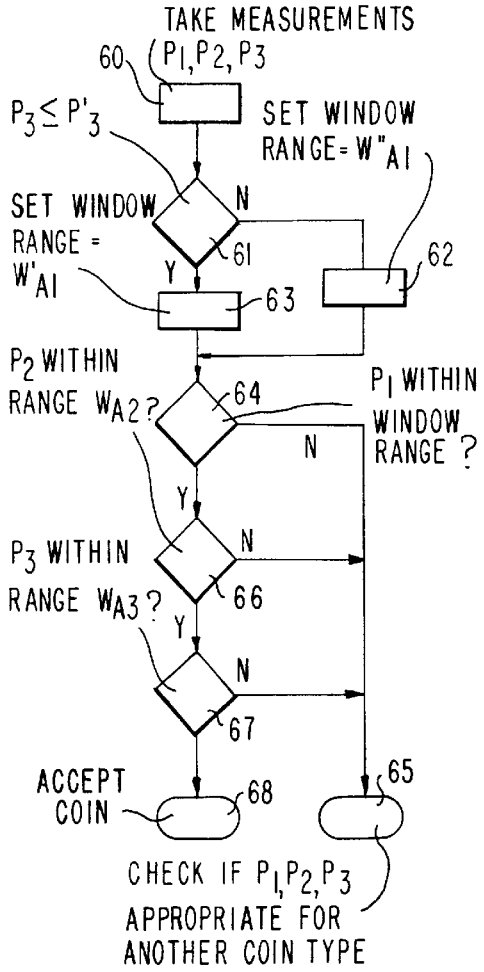

METHOD AND APPARATUS FOR VALIDATING MONEY

This is a divisional of application Ser. No. 07/848,989 filed on Apr. 29, 1992 now abandoned, which is a continuation of PCT/GB90/01588 filed Oct. 15, 1990.

FIELD OF THE INVENTION

This invention relates to a method and apparatus for validating items of money, such as coins or banknotes.

BACKGROUND OF THE INVENTION

It is known when validating coins to perform two or more independent tests on the coin, and to determine that the coin is an authentic coin of a specific type or denomination only if all the test results equal or come close to the results expected for a coin of that type. For example, some known validators have inductive coils which generate electromagnetic fields. By determining the influence of a coin on those fields the circuit is capable of deriving independent measurements which are predominantly determined by the thickness, the diameter and the material content of the coins. A coin is deemed authentic only if all three measurements indicate a coin of the same type.

This is represented graphically in FIG. 1, in which each of the three orthogonal axes $P_1$, $P_2$ and $P_3$ represent the three independent measurements. For a coin of type A, the measurement $P_1$ is expected to fall within a range (or window) $W_{A1}$, which lies within the upper and lower limits $U_{A1}$ and $L_{A1}$. Similarly the properties $P_2$ and $P_3$ are expected to lie within the ranges $W_{A2}$ and $W_{A3}$, respectively. If all three measurements lie within the respective windows, the coin is deemed to be an acceptable coin of type A. In these circumstances, the measurements will lie within an acceptance region indicated at $R_A$ in FIG. 1.

In FIG. 1, the acceptance region $R_A$ is three dimensional, but of course it may be two dimensional or may have more than three dimensions depending upon the number of independent measurements made on the coin.

Clearly, a coin validator which is arranged to validate more than one type of coin would have different acceptance regions $R_B$, $R_C$, etc., for different coin types B, C, etc.

The techniques used to determine authenticity vary. For example, each coin property measurement can be compared against stored upper and lower limit values defining the acceptance windows. Alternatively, each measurement may be checked to determine whether it is within a predetermined tolerance of a specific value. Alternatively, each measurement may be checked to determine whether it is equal to a specific value, in which case the permitted deviation of the measurement from an expected value is determined by the tolerance of the circuitry. GB-A-1 405 937 discloses circuitry in which the tolerance is determined by the selection of the stages of a digital counter which are decoded when the count representing the measurement is checked.

In a coin validator which is intended for validating a plurality of coin types or denominations each measurement can be checked against the respective range for every coin type before reaching the decision as to whether a tested coin is authentic, and if so the denomination of the coin. Alternatively, one of the tests could be used for pre-classifying the coin so that subsequent test measurements are only checked against the windows for the coin types determined by the pre-classification step. For example, in GB-A-1 405 937, a first test provisionally classifies the coin into one of three types, in dependence upon the count reached by a counter. The counter is then caused to count down at a rate which is determined by the results of the pre-classification test. If the final count is equal to a predetermined number (e.g. zero), the coin is determined to be a valid coin of the type determined in the pre-classification test.

In the prior art, each acceptance window is always predetermined before the test is carried out. Some validators have means for adjusting the acceptance windows. The purpose of the adjustment is to either increase the proportion of valid coins which are determined to be acceptable (by increasing the size of the acceptance window) or to reduce the number of counterfeit coins which are erroneously deemed to be valid (by reducing the size of the acceptance window). Adjustment of the window is carried out either manually, or automatically (e.g. as in EP-A-0155126). In any event, the result of the window adjustment is that the upper and lower limits of the acceptance window are predetermined.

However, by reducing the acceptance windows in order to avoid accepting counterfeit coins, it is possible that genuine coins will then be found to be invalid. Conversely, by increasing the acceptance windows to ensure that a maximum number of genuine coins are found to be valid, more counterfeit coins may also be determined to be valid. The consequence is that adjustment of windows may have adverse effects as well as beneficial effects, and may not increase the "acceptance ratio" (i.e. the ratio of the percentage of valid coins accepted to the percentage of counterfeit coins accepted), or may only increase this ratio by a small amount.

In the field of banknote validation, measurements are also compared with acceptance regions generally of the form shown in FIG. 1. Similar problems thus arise when modifying the acceptance windows to try to avoid accepting counterfeit notes or rejecting genuine notes.

SUMMARY OF THE INVENTION

It has been known to provide a coin mechanism which stores acceptance windows appropriate for coins of several different denominations to "re-program" the windows for one particular denomination using a self-learning technique (see EP-A-0 155 126) so that they instead match the properties of a particular, known "slug" (i.e., a non-genuine coin used to defraud the machine), and then to set the machine so that it will not accept "coins" of that particular denomination. Thus, whenever the known slug is inserted into the machine, its properties are found to lie within the windows for a particular denomination, and the slug is then rejected because the machine has been set to inhibit acceptance of that denomination. This technique is highly effective for avoiding acceptance of such slugs, even when the properties of the slugs lie within the ranges for a different, genuine coin denomination. The acceptance region for the genuine denomination is effectively reduced by the amount of overlap with the "acceptance region" for the slugs, because any slugs are rejected. However, this technique is only effective for a single specific slug with known properties, and the effect it has on the acceptance ratio for genuine coins is indeterminate.

According to one aspect of the present invention there is provided a method of validating items of money comprising deriving at least first and second measurements of a tested item, determining whether said first and second measurements effectively lie within, respectively, first and second ranges associated with a particular money type, and producing a signal indicating that money of that type has been tested if all measurements fall within the respective ranges for that type, characterised in that the width of at least the first range for said money type varies in dependence on at least the second measurement.

Other aspects of the invention are set out in the accompanying claims.

The first and second measurements are preferably "different measurements". The reference to "different measurements" is intended to indicate the measurement of different physical characteristics of the tested item, as distinct from merely taking the same measurement at different times to indicate a single physical characteristic or combination of such characteristics. For example, in GB-A-1 405 937, and in several other prior art arrangements, the time taken for a coin to travel between two points is measured. Although this could be regarded as taking two time measurements and subtracting the difference, the purpose is simply to obtain a single measurement determined by a particular combination of physical characteristics, and therefore this does not represent "different measurements" as this is understood in the present case. Similarly, it is known to take two successive measurements dependent on the position of a coin with respect to a sensor as the coin passes the sensor, and then to take the difference between those two measurements. Again, this difference would represent a single measurement determined by a single combination of physical characteristics (e.g. a variation in the surface contour of the coin).

In many circumstances, using the invention enables selection of windows which result in an improved acceptance ratio. For example, it may be found empirically that measurements $P_1$ and $P_2$ of valid money items of type A tend to lie within ranges $W_{A1}$ and $W_{A2}$ respectively. However, it may also be found empirically that genuine items having a large value $P_1$ are unlikely also to have a large value $P_2$. Using the techniques of the invention, the upper limit of range $W_{A2}$ can be made smaller when large values of $P_1$ are detected. This would not significantly affect the number of valid items which are erroneously rejected, but would cause counterfeit items which may have large values of $P_1$ and $P_2$ to be rejected.

The invention can be carried out in many ways.

Some examples are:

(1) A plurality of windows ($W'_{A1}$, $W''_{A1}$, etc.) may be stored for a single property measurement $P_1$ of a single money type A. The window to be used may be selected on the basis of a different property measurement, e.g. $P_2$.

(2) Two or more property measurements may be combined in order to derive a value which is a predetermined function of these measurements, and the result may be compared with a predetermined acceptance window. Because the derived value is a function of two measurements, it will be understood that the permitted range of values for each measurement will be dependent upon the other measurement(s).

The invention also extends to money validating apparatus arranged to operate in accordance with a method of the invention, and to a method of setting-up such an apparatus.

BRIEF DESCRIPTION OF THE DRAWINGS

Arrangements embodying the invention will now be described by way of example with reference to the accompanying drawings, in which:

FIG. 1 schematically illustrates an acceptance region in a conventional validator;

FIG. 2 is a schematic diagram of a coin validator in accordance with the present invention;

FIG. 3 illustrates by way of example a table stored in a memory of the validator of FIG. 2, the table defining acceptance regions;

FIG. 4 schematically illustrates an acceptance region for the validator of FIG. 2;

FIG. 5 is a flowchart illustrating one possible method of operation of the validator of FIG. 2;

FIG. 6 illustrates an alternative method of operation;

DETAILED DESCRIPTIONS

Figure 7:
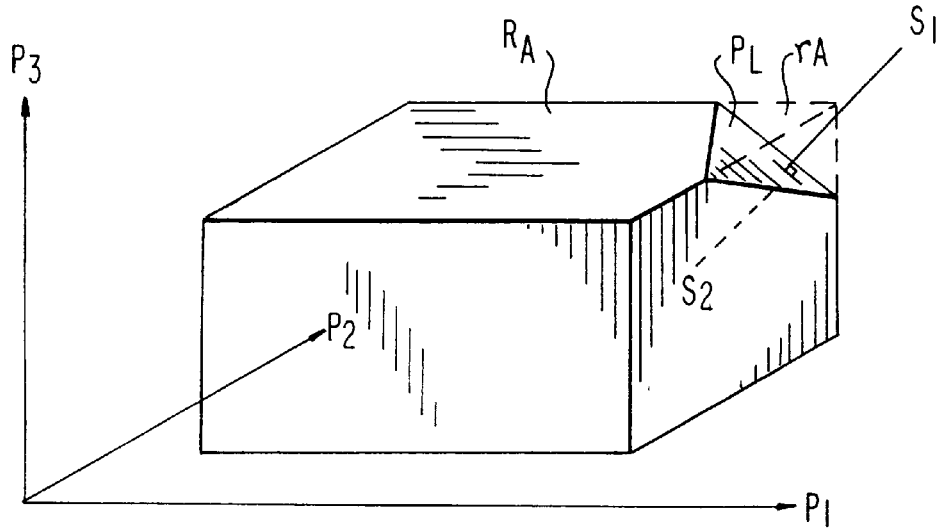
FIG. 7 illustrates an acceptance region in a modification of the embodiment of FIG. 2.

The coin testing apparatus 2 shown schematically in FIG. 2 has a set of coin sensors indicated at 4. Each of these is operable to measure a different property of a coin inserted in the apparatus, in a manner which is in itself well known. Each sensor provides a signal indicating the measured value of the respective parameter on one of a set of output lines indicated at 6.

An LSI 8 receives these signals. The LSI 8 contains a read-only memory storing an operating program which controls the way in which the apparatus operates. Instead of an LSI, a standard microprocessor may be used. The LSI is operable to compare each measured value received on a respective one of the input lines 6 with upper and lower limit values stored in predetermined locations in a PROM 10. The PROM 10 could be any other type of memory circuit, and could be formed of a single or several integrated circuits, or may be combined with the LSI 8 (or microprocessor) into a single integrated circuit.

The LSI 8, which operates in response to timing signals produced by a clock 12, is operable to address the PROM 10 by supplying address signals on an address bus 14. The LSI also provides a "PROM-enable" signal on line 16 to enable the PROM.

In response to the addressing operation, a limit value is delivered from the PROM 10 to the LSI 8 via a data bus 18.

By way of example, one embodiment of the invention may comprise three sensors, for respectively measuring the conductivity, thickness and diameter of inserted coins. Each sensor comprises one or more coils in a self-oscillating circuit. In the case of the diameter and thickness sensors, a change in the inductance of each coil caused by the proximity of an inserted coin causes the frequency of the oscillator to alter, whereby a digital representation of the respective property of the coin can be derived. In the case of the conductivity sensor, a change in the Q of the coil caused by the proximity of an inserted coin causes the voltage across the coil to alter, whereby a digital output representative of conductivity of the coin may be derived. Although the structure, positioning and orientation of each coil, and the frequency of the voltage applied thereto, are so arranged that the coil provides an output predominantly dependent upon a particular one of the properties of conductivity, diameter and thickness, it will be appreciated that each measurement will be affected to some extent by other coin properties.

The apparatus so far described corresponds to that disclosed in GB-A-2094008. In that apparatus, on insertion of a coin, the measurements produced by the three sensors 4 are compared with the values stored in the region of the PROM 10 shown in FIG. 3. The thickness measurement is compared with the twelve values, representing the limits of six ranges for the respective coins A to F, in the row marked $P_1$ in FIG. 3. If the measured thickness value lies within the upper and lower limits of the thickness range for a particular coin (e.g. if it lies between the upper and lower limits $U_{A1}$ and $L_{A1}$ for the coin A), then the thickness test for that coin has been passed. Similarly, the diameter measurement is compared with the twelve upper and lower limit values in the row $P_2$, and the conductivity measurement is compared with the limit values in the row marked $P_3$.

If and only if all the measured values fall within the stored ranges for a particular coin denomination which the apparatus is designed to accept, the LSI 8 produces an ACCEPT signal on one of a group of output lines 24, and a further signal on another of the output lines 24 to indicate the denomination of the coin being tested. The validator has an accept gate (not shown) which adopts one of two different states depending upon whether the ACCEPT signal is generated, so that all tested coins deemed genuine are directed along an accept path and all other tested items along another path.

The validator of GB-A-2094008 has acceptance regions, defined by the values stored in PROM 10, generally of the form shown in FIG. 1. In the present embodiment of the invention, however, one of the six acceptance regions has the form shown at $R_A$ in FIG. 4. This differs from the region of FIG. 1 in that it has been reduced by the volume shown at $r_A$. Thus, any received items having properties falling within the volume $r_A$ will not be accepted by the validator. Assuming that it is found statistically that there is a fairly high likelihood of counterfeit coins having properties lying within $r_A$, and a fairly remote possibility of genuine coins of type A having properties lying within this region, then the acceptance ratio is improved.

The acceptance regions $R_B$, $R_C$, etc., each have the form shown in FIG. 1, although if desired each could be modified to the form shown in FIG. 4.

One possible way of operating the validator is explained below with reference to FIG. 5. At step 50,the LSI takes all three of the measurements $P_1$, $P_2$ and $P_3$. At step 51, the program proceeds to check whether the measurement $P_1$ is within the acceptance range indicated at $W'_{A1}$ in FIG. 4. This is defined by the upper and lower limits $U_{A1}$ and $L_{A1}$, stored in the PROM 10, shown in FIG. 3. If the measurement $P_1$ lies outside this range, the program proceeds as indicated as step 52 to check whether the measurements $P_1$, $P_2$ and $P_3$ are appropriate for any of the other coin types B, C, etc.

Otherwise, at step 53,the program checks whether the measurement $P_2$ lies within the respective range $W_{A2}$, and then at step 54 whether the measurement $P_3$ lies within the respective range $W_{A3}$. If all three property measurements lie within the respective ranges for the coin type A, the program proceeds to step 55, wherein the program checks whether the property measurement $P_1$ is less than or equal to a predetermined value $P'_1$ shown in FIG. 4. If so, this indicates that the property measurements lie within the non-shaded region of $R_A$, and the coin is deemed acceptable. Accordingly, the program proceeds to step 56 where the appropriate signals indicating a valid coin of denomination A are issued.

If $P_1 \geqq P'_1$, then at step 57 the program checks whether $P_3 \leqq P'_3$. If so, then the property measurements have been found to lie within the shaded region shown in FIG. 4, and the coin is deemed acceptable. Accordingly, the program proceeds to step 56.

However, if $P_3 > P'_3$, the property measurements have been found to lie within the region $r_A$, and the inserted item is therefore deemed not to be a coin of type A. Accordingly, the program proceeds to step 52.

Thus, the permissible window range for the property $P_3$ depends upon whether or not the measurement $P_1$ is greater than or less than a predetermined value $P'_1$. Similarly, the range for $P_1$ depends upon whether or not $P_3$ is greater than or less than $P'_3$. With prior art arrangements having acceptance regions as shown in FIG. 1, it would be possible to reduce the acceptance window $W'_{A1}$ for property $P_1$ to $W''_{A1}$. However, the modified range would be applicable for all values of $P_3$, thereby resulting in an acceptance region corresponding to the non-shaded portion of $R_A$. In FIG. 4, the acceptance region also includes the shaded volume, so that rejection of genuine coins is less likely to occur.

FIG. 6 is a flowchart illustrating an alternative technique for achieving the acceptance region shown in FIG. 4. At step 60, the property measurements $P_1$, $P_2$ and $P_3$ are taken. At step 61, the property measurement $P_3$ is compared with a predetermined value $P'_3$. If $P_3$ is greater than $P'_3$, the program proceeds to step 62; otherwise the program proceeds to step 63. At step 62, the window range $W_{A1}$ for property measurement $P_1$ is set equal to $W''_{A1}$, and at step 63, the window is set equal to $W'_{A1}$. The PROM 10 may be arranged to store two sets of limits $U'_{A1}$, $L'_{A1}$, $U''_{A1}$ and $L''_{A1}$, in place of the single set $U_{A1}$ and $L_{A1}$, in FIG. 3, so that the two window ranges $W'_{A1}$ and $W''_{A1}$ can be derived.

At step 64,the property measurement $P_1$ is compared with the appropriate window range determined at step 62 or 63, and if it is found to fall outside this range, the program proceeds to step 65. Thereafter, the program proceeds to check whether the property measurements are appropriate for the remaining coins B, C, etc.

Otherwise, the program checks to determine whether property $P_2$ lies within the associated window $W_{A2}$ at step 66, and then at step 67 checks whether property measurement $P_3$ lies within the range $W_{A3}$. If all three properties lie within the respective ranges, then the program proceeds to step 68, where the signals indicating acceptance of a genuine coin of denomination A are issued.

In FIGS. 5 and 6, each property is checked against a range for a particular denomination, and the ranges for other denominations are checked only if the coin fails the test for that denomination.

Alternatively, each property measurement may be checked against the respective windows for every denomination before determining which coin denomination has been received. Obviously, other sequences of operation are possible.

FIG. 7 shows the acceptance region $R_A$ in a further embodiment of the invention. The acceptance region $R_A$ is similar to that shown in FIG. 1 except that it has been reduced by the volume indicated at $r_A$ at one corner. The volume $r_A$ is defined by the interception of the region $R_A$ and a plane indicated at PL.

One possible technique for achieving the acceptance region shown in FIG. 7 is described with reference to FIG.

8. At step 100, the property measurements $P_1$, $P_2$ and $P_3$ are taken. At step 102, the program checks to determine whether the following conditions are met:

$$c_1P_1+c_2P_2+c_3P_3+c_4 \leqq 0,$$

where $c_1$, $c_2$, $c_3$ and $c_4$ are predetermined coefficients stored in a memory (e.g. the PROM 10) of the validator. If the conditions are not met, this indicates that the property measurements define a point which is located on the side $S_1$ of the plane PL shown in FIG. 7, and therefore the program proceeds to step 104, where the property measurements are checked against the acceptance regions for coin denominations B, C, etc. in the conventional way. Otherwise, the program proceeds to step 105, where the property measurements are compared with the acceptance region $R_A$, in the normal way. This step will be reached only if the property measurements lie on the side $S_2$ of the plane PL. If the measurements are found to lie within the region $R_A$, the program proceeds to step 106, where the signals indicating receipt of genuine coin of denomination A are issued. Otherwise, the program proceeds to step 104 to check for other denominations.

In the examples given above, the reductions $r_A$ in the unmodified acceptance region $R_A$ are located at a corner or along an edge of the region $R_A$. This is not essential. It may in some circumstances be desirable to locate the region $r_A$ closer to the centre of the region $R_A$, or towards the centre of a surface thereof. For example, referring to FIG. 1, the reduction region $r_A$ could be in the form of a trough extending along the centre of one of the surfaces defining the region $R_A$. This may be of use in validating coins which produce different measurements depending upon their orientation within the validator when being tested, e.g. depending upon whether a coin is inserted with its "heads" side on the left or right. Such measurements may be grouped in one or two major areas depending upon orientation, so that properties which are found to lie in a central region indicate that the tested item is unlikely to be genuine.

Figure 11:
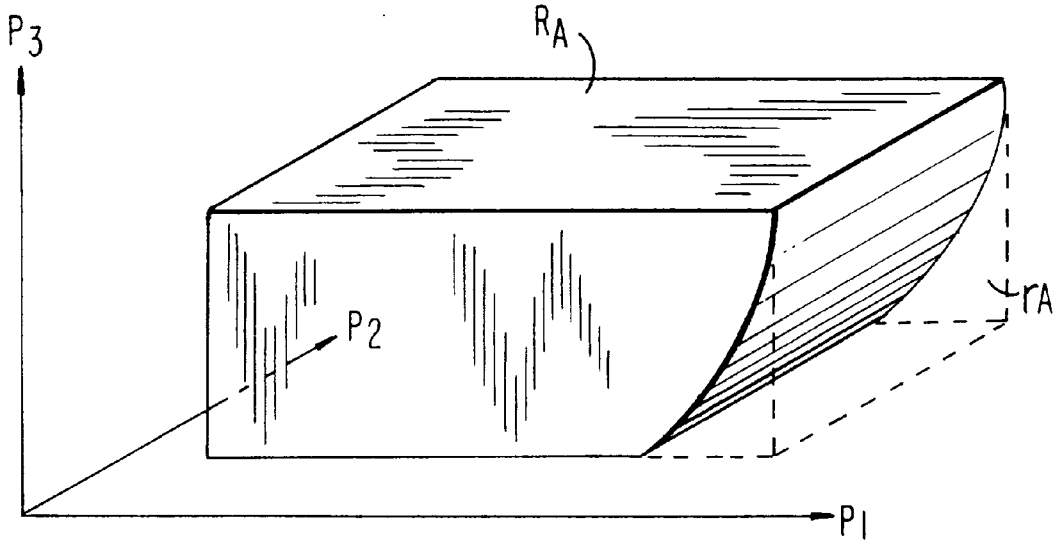
FIGS. 11 and 12 illustrate non-planar acceptance regions.
Figure 12:
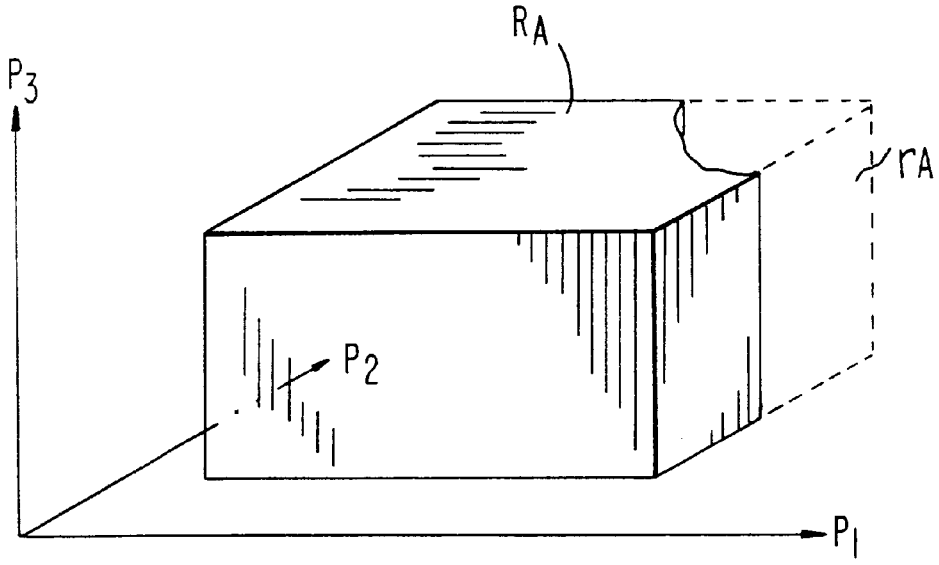

In all the above embodiments, the boundaries of the acceptance region $R_A$ are planar. It will be appreciated that they could have any configuration. For example, FIGS. 11 and 12 depict non-planar boundaries which could be achieved by using a non-linear equation at step 102. The conditions:

$$c_1P_1+c_2P_2+c_3P_3+c_4+c_5-P_1^2 \leqq 0, \text{ and } P_1P_2 \leqq k,$$

results in the acceptance regions $R_A$ shown in FIGS. 11 and 12, respectively, where $c_1$ to $c_5$ and k are predetermined values.

Obviously, two or more such equations may be used.

In any of the described embodiments, it is possible to modify as many of the coin acceptance regions $R_A$, $R_B$ . . . $R_F$ from the general form shown in FIG. 1 as desired. In addition, any of the acceptance regions may be reduced by more than one of the volumes $r_A$. In the FIG. 4 example wherein the unmodified acceptance region $R_A$ is reduced by the region $r_A$ in one corner thereof, it could additionally be reduced by other volumes located in separate positions. Similarly, in FIG. 7 other surfaces could intersect the acceptance region $R_A$ to define additional non-acceptance regions $r_A$.

Figure 8:
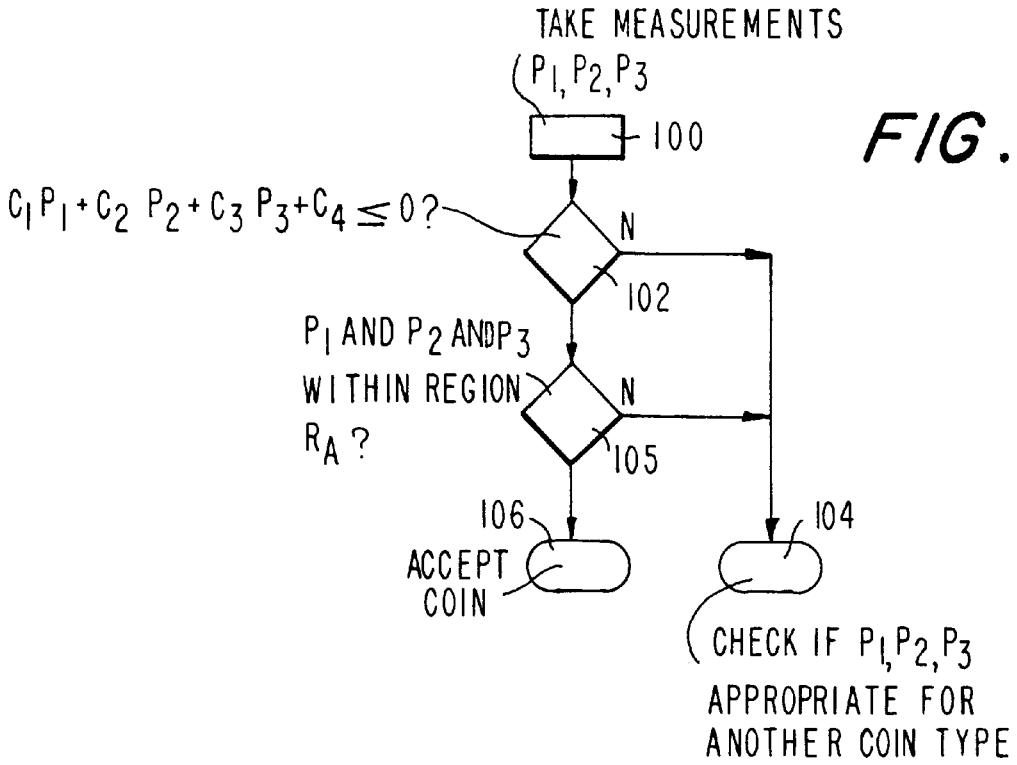
FIG. 8 is a flowchart of the operation of the modification of FIG. 7.

In the above embodiments, the effective acceptance region is defined by sets of windows (representing the unmodified region $R_A$) together with additional parameters representing the reduction $r_A$ in that region. However, it is not essential that the unmodified window limits be employed. Instead, the entire effective acceptance region $R_A$ can be defined by, for example, formulae such as those used in the embodiment of FIGS. 7 and 8.

Figure 9:
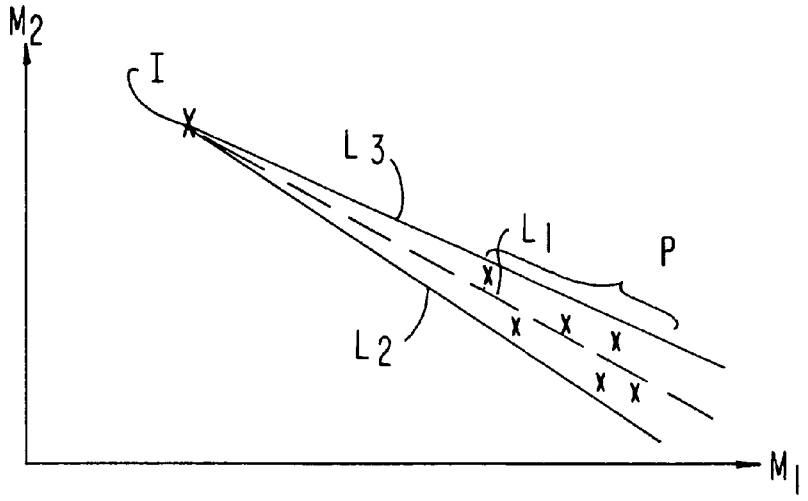
FIG. 9 is a graph showing the distribution of measurements of a plurality of coins of the same type.

One example of this will be described with reference to FIGS. 9 and 10. Referring to FIG. 9, this shows the distribution of two measurements of a plurality of coins of the same type passing through the same validator. The measurements $M_1$ and $M_2$ are represented by respective axes of the graph of FIG. 9. I represents the idle measurement, i.e. the values $M_1$ and $M_2$ obtained when no coin is present in the validator. The points P represent the measurements of the respective coins. It will be noted that although the positions of the points vary substantially, they are all grouped around a line $L_1$, and within a region bounded by lines $L_2$ and $L_3$. This grouping is an empirically observed result of statistical analysis.

It is possible, therefore, to test for the presence of a genuine coin by determining whether the measurements $M_1$ and $M_2$ of the coin lie within the boundaries $L_2$ and $L_3$. In the present embodiment, this is done by calculating further measurements $P_1$, and $P_2$, such that $P_1$, represents the amount by which the measurement $M_1$ exceeds the idle value of that measurement, and $P_2$ represents the amount by which $M_2$ falls below the idle value. The following test is then performed:

$$L_L \leq \frac{P_2}{P_1} \leq U_L,$$

where $L_L$ and $U_L$ are respectively predetermined lower and upper limits, corresponding to lines $L_3$ and $L_2$.

Figure 10:
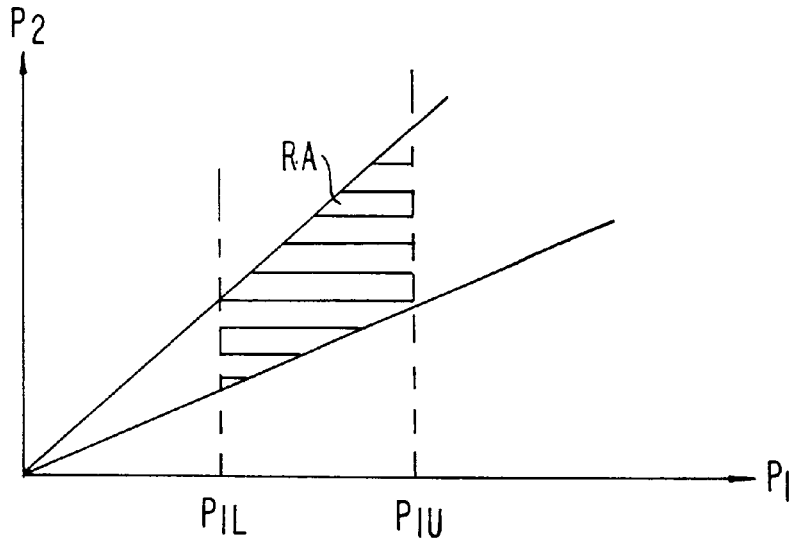
FIG. 10 illustrates an acceptance region in a further modification of the embodiment of FIGS. 11 and 12 illustrate non-planar acceptance regions.

This results in an acceptance region $R_A$ occupying the area between the inclined lines shown in FIG. 10. This arrangement imposes no limits on the absolute values of $P_1$ and $P_2$. In practice, it may be desirable to impose such limits, for example by testing for $$P_{1L} \leqq P_1 \leqq P_{1U},$$

where $P_{1L}$ and $P_{1U}$ are respectively lower and upper predetermined limits. This will result in the acceptance region $R_A$ occupying only the shaded region in FIG. 10.

It will be understood that the steps used to carry out this technique can correspond to those conventionally used in validators, except for the calculation of $$\frac{P_2}{P_1}$$

which is carried out before the resulting value is checked against window limits.

The references throughout the specification to windows or ranges are intended to encompass ranges with a lower limit of zero or with an upper limit of infinity. That is to say, a property measurement can be deemed to be within an associated range merely by determining whether it lies above (or below) a particular value.

References herein to coins are intended to encompass also tokens and other coin-like items.

Although the preceding description relates to the field of coin validation, it will be understood that the techniques are similarly applicable to banknote validation.

We claim:

1. A coin validating apparatus comprising:

sensor means for sensing a coin and producing at least first and second different coin measurements;

memory means for storing, for a particular coin type, data defining an acceptance region in the coordinate systems defined by axes represented by said first and second measurements, said acceptance region being defined by rectilinear boundaries, and being shaped to include first and second different effective ranges of the first measurement along the axis representing the second measurement and vice versa, the first effective ranges comprising ranges of measurement values which are likely to correspond to valid coins of said particular type, each first effective range extending beyond the corresponding second effective range, said acceptance region including a region in which the second effective range for the first measurement coincides with the first effective range for the second measurement, and a region in which the second effective range for the second measurement coincides with the first effective range for the first measurement, and excluding a rectilinear exclusion region, lying within the first effective ranges and outside the second effective ranges; and means for determining whether said first and second measurements define a point within said acceptance region, and for accepting a coin as corresponding to said particular type when said first and second measurements define a point which lies within said acceptance region, and for treating said coin as not corresponding to said particular type when said first and second measurements define a point which lies outside said acceptance region.

2. The apparatus of claim 1, in which the rectilinear exclusion region comprises points defined by combinations of said first and second measurements to which valid coins of said particular type are unlikely to correspond.

3. The apparatus of claim 1, in which the rectilinear exclusion region comprises points defined by combinations of said first and second measurements to which invalid coins of said particular type are likely to correspond.

4. Apparatus according to claim 1 in which said exclusion region is located at a corner of said acceptance region.

5. Apparatus according to claim 1 in which said exclusion region is located at an edge of said acceptance region.

6. Apparatus according to claim 1 in which said memory means stores data defining a plurality of acceptance regions corresponding to a plurality of different coins.

7. Apparatus according to claim 1 in which said memory means stores data for defining said first and second effective ranges for each of said first and second coin measurements.

8. Apparatus according to claim 7 in which the memory means stores, to represents each said effective range, upper and lower window limit values.

9. Apparatus according to claim 1, in which the determining means is arranged to determine whether said first and second measurements define a point within said acceptance region by determining whether said first measurement falls within its respective first effective range and the second measurement falls within its respective second effective range or whether the first measurement lies within its respective second effective range and the second measurement lies within its respective first effective range.

10. Apparatus according to claim 1 in which said sensor means comprise a plurality of inductive coils.

11. Apparatus according to claim 1 wherein said memory means comprises a programmable read only memory (PROM).

12. Apparatus according to claim 1 wherein said first and second measurements are substantially independent.

13. Apparatus according to claim 1 wherein the measurements represent the change from an idling value of a parameter to the parameter value when a coin is being measured.

14. Apparatus according to claim 1 wherein the first and second measurements are at least predominantly measurements of respective properties selected from the group of conductivity, thickness and diameter of the tested coin.

15. Apparatus according to claim 1 comprising deriving first, second and third measurements which are predominantly measurements of conductivity, thickness and diameter of the tested coin.

16. A method of validating coins which comprises:

deriving at least first and second different measurements of a tested coin, determining whether the measurements define a point within an acceptance region corresponding to a particular coin type in the coordinate system defined by axes representing said first and second measurements; and producing a signal indicating that a coin of that type has been tested if the point lies within the acceptance region; said acceptance region being defined by rectilinear boundaries, and being shaped to include first and second different effective ranges of the first measurement along the axis representing the second measurement and vice versa, the first effective ranges comprising ranges of measurement value which are likely to correspond to valid coins of said particular type, each first effective range extending beyond the corresponding second effective range, said acceptance region including a region in which the second effective range for the first measurement coincides with the first effective range for the second measurements, and a region in which the second effective range for the second measurement coincides with the first effective range for the first measurement, and excluding a rectilinear exclusion region, lying within the first effective ranges and outside the second effective ranges.

17. The method of claim 16, in which the rectilinear exclusion region comprises points defined by combinations of said first and second measurements to which valid coins of said particular type are unlikely to correspond.

18. The method of claim 16, in which the rectilinear exclusion region comprises points defined by combinations of said first and second measurements to which invalid coins are likely to correspond.

19. A method according to claim 16 in which said exclusion area is located at a corner of said exclusion region.

20. A method according to claim 16 in which said exclusion area is located at an edge of said exclusion region.

21. A method according to claim 16 comprising determining whether said point lies within one of a plurality of stored acceptance regions corresponding to a plurality of different coins.

22. A method as claimed in claim 16 wherein said first and second measurements are substantially independent.

23. A method as claimed in claim 16 wherein the measurements represent the difference between an idling value of a parameter and the parameter value when a coin is being measured.

24. A method as claimed in claim 16 wherein the first and second measurements are at least predominantly measurements of respective properties selected from the group of conductivity, thickness and diameter of the tested coin.

25. A method as claimed in claim 16 comprising deriving first, second and third measurements which are predominantly measurements of conductivity, thickness and diameter of the tested coin.

26. Coin discrimination apparatus comprising:

means defining a path for the passage of coins under test;

first and second sensor means for sensing a coin during its passage along the path;

means responsive to said sensor means for producing first and second coin signals for the first and second sensor means respectively, the coin signals having values in dependence upon the coin under test;

memory means storing data for de fining first and second windows each having a width for acceptable values of the coin signals; and means for comparing said coin signals with data stored in said memory to determine if the coin signals fall within the windows, wherein the data for the first and second windows are stored respectively for providing both a first and a second window width, where in the first window width corresponds to the width of a distribution of coin signals associated with acceptable coins of a particular denomination, and the second window width corresponds to the width of said distribution but excludes therefrom a range of values corresponding to fraudulent coins, and a coin under test is deemed to be acceptable upon the coin signals falling either within a first or a second acceptance condition wherein, for the first acceptance condition, the value of the first coin signal falls within the first window width of the first window and the value of the second coin signal falls within the second window width of the second window, and for the second acceptance condition the value of the first coin signal falls within the second window width of the first window and the value of the second coin signal falls within the first window width of the second window.

27. Apparatus according to claim 26, including a third sensor means for sensing the passage of a coin along the path for producing a third coin signal said memory means storing data for defining a third window of a width corresponding to the width of a distribution of coin signals associated with acceptable coins of said particular denomination, wherein said first and second acceptance conditions require the third coin signal to be within the width of the third window.

28. Apparatus according to claim 26, wherein said memory means includes data for defining a plurality of sets of windows corresponding to coins of different denominations.

29. Apparatus according to claim 26, wherein the memory means comprises a PROM.

30. Apparatus according to claim 26, wherein said comparing means comprises a microprocessor.

31. Apparatus according to claim 26, wherein each of said sensor means includes a plurality of inductive sensor coils arranged to produce respective different inductive couplings with a coin under test.

32. Coin discrimination apparatus according to claim 26 including an accept gate operated to accept a coin in response to said first or second acceptance condition.

33. A method of discriminating between coins comprising the steps of: performing first and second tests upon a coin so as to develop first and second coin signals in dependence upon the coin under test; storing data for a first window and a second window for respectively providing both a first and a second window width, wherein the first window width corresponds to the width of a distribution of coin signals associated with acceptable coins of a particular denomination, and the second window width corresponds to the width of said distribution but excludes therefrom a range of values corresponding to fraudulent coins, comparing said first and second coin signals with said first and second windows; and accepting a coin upon the coin signals falling either within a first or a second acceptance condition wherein said first acceptance condition is achieved when the value of the first coin signal falls within said first window width of said first window, and the value of the second coin signal falls within said the second window width of said second window, and wherein said second acceptance condition is achieved when the value of the first coin signal falls within said second window width of said first window, and the value of the second coin signal falls within said first window width of said second window.

34. A method according to claim 33 further comprising the steps of performing a third test on the coin to produce a third coin signal, and comparing the third coin signal with a third window, wherein the first and second acceptance conditions require the third coin signal to be within the width of the third window.

35. A method according to claim 33 further comprising the steps of comparing the coin signals with a plurality of sets of windows corresponding to coins of different denominations.

* * * * *

UNITED STATES PATENT AND TRADEMARK OFFICE

CERTIFICATE OF CORRECTION

PATENT NO. : 5,984,074 
DATED : November 16, 1999
INVENTOR(S) : David M. Furneax and Richard Douglas Allan It is certified that error appears in the above-identified patent and that said Letters Patent is hereby corrected as shown below:

Column 4,
Lines 22-23, delete "FIGS. 11 and 12 illustrate non-planar acceptance regions", and insert -- FIG. 2; --.
Line 26, change "DESCRIPTIONS" to -- DESCRIPTION --.

Column 7,
Line 48, change "results" to -- result --.

Column 11,
Line 5, change "de fining" to -- defining --.
Line 12, change "where in" to -- wherein --.

Column 12,
Line 26, delete "the" after "said".

Signed and Sealed this

Eleventh Day of February, 2003

JAMES E. ROGAN
*Director of the United States Patent and Trademark Office*